United States Patent [19]

Tobler et al.

[11] 3,988,070

[45] Oct. 26, 1976

[54] SKI WAX APPLICATOR

[75] Inventors: Hans Jörg Tobler, Altstatten; Hansruedi Lüchinger, Oberriet, both of Switzerland

[73] Assignee: Tobler Holding AG, Altstatten, Switzerland

[22] Filed: June 3, 1975

[21] Appl. No.: 584,239

[30] Foreign Application Priority Data

June 4, 1974 Austria ..... 4615/74

[52] U.S. Cl. ..... 401/2; 401/137

[51] Int. Cl.[2] ..... A63C 11/07

[58] Field of Search ..... 401/1, 2, 5, 137

[56] References Cited

UNITED STATES PATENTS

| | | | |
|---|---|---|---|
| 1,312,347 | 8/1919 | Ogden | 401/2 |
| 1,328,769 | 1/1920 | Spencer | 401/1 |
| 2,118,415 | 5/1938 | Pesark | 401/1 |
| 3,485,417 | 12/1969 | Cocks | 401/1 X |

FOREIGN PATENTS OR APPLICATIONS

| | | | |
|---|---|---|---|
| 42,413 | 3/1970 | Finland | 401/1 |
| 960,164 | 3/1957 | Germany | 401/1 |
| 88,916 | 4/1921 | Switzerland | 401/1 |

*Primary Examiner*—Lawrence Charles
*Attorney, Agent, or Firm*—Sughrue, Rothwell, Mion, Zinn and Macpeak

[57] ABSTRACT

A device for dispensing wax for application on skis is disclosed. The device, operated by hand, utilizes a valve to release in a uniform manner melted wax from a plurality of discharge openings at the bottom of the device. The discharge openings are placed in conjunction with triangular surface parts which place an optimum film of wax on the running surface of the skis. Once the wax is applied, it may be ironed onto the running surface by means of a heated element on one side of the device.

3 Claims, 3 Drawing Figures

SKI WAX APPLICATOR

BACKGROUND OF THE INVENTION

1. Field of the Invention

The present invention relates to a device for the application of ski wax, with an electrically heatable wax container, in the outside bottom surface of which, serving as an application surface, at least one wax discharge opening has been provided, which is connected with the wax container by at least one closeable channel.

2. Description of the Prior Art

The present day, modern ski waxes for racing skiers are used fundamentally differently from the earlier ski waxes. Whereas the traditional aki waxes were applied on the coating material in an actual layer, the present day high performance waxes must be sealed with the coating material. That means, no thick layer is applied any more, as had been done hitherto, but now one must strive to fuse so-to-speak as thin as possible a film by the action of heat with said coating material.

The present day coating materials are made of polyethylene, the crystalline structure of which forms a fine porosity which can absorb waxes. The excess wax is again removed with a scraper up to the coating. The racing skier therefore glides or slides on a surface in which wax crystals and polyethylene crystals are intermixed, whereby the interaction of both types of crystals results in the optimum sliding effect.

In German Pat. No. 960.164 a device for the application of ski wax according to the hitherto practiced method has been described. With the help of this device the wax can be applied to the coating material in a thick layer. The quantity of discharge of the wax cannot be controlled and the wax discharge begins at the moment when the device comes into contact with the surface of the ski. This device is not suitable for any preheating of the coating and a subsequent ironing in of the wax film.

Furthermore, an apparatus for spread coating of a thin layer from a liquid or semi-liquid material onto a series of plates has been known from German application, open to public inspection, Ser. No. 2,106,522. The outside bottom surface of this apparatus is tilted by means of a spacer disposed posteriorly, in order to determine the thickness of the layer. This apparatus too, is not suitable for spreading and subsequent smoothing of the layer applied.

SUMMARY OF THE INVENTION

It is the task of the invention to improve the previously known devices in such a way that the application of modern high performance ski waxes will be possible in a thin, smoothed out layer sealed with the coating material. According to the invention this task is solved in that a part of the bottom surface is displaced backwards in the manner of a recess in relation to the remaining part of the bottom, and the recessed part of the bottom has at least two approximately triangular surface parts running at the same level, each of which comprises a wax discharge opening, being in connection with the wax container by way of at least one channel, that can be closed by a valve.

An advantageous embodiment of the invention is distinguished by the fact that said valve is a box valve, which can be operated by hand by way of an operating element disposed near a handle.

A valve operated by hand has the distinct advantage over a valve which functions with contact pressure, that on the one hand the quantity of wax is dosed and on the other hand the flow of wax can be turned off, as soon as the film of wax has been spread on the ski. As soon as the wax has been spread the wax film is ironed into the coating. For this treatment it is essential that it must be possible to completely discontinue the flow of wax.

Finally, the waxing device can be set down immediately during heating up or also after use onto a rest or trivet plate without any wax flowing out.

For easy handling of the device, a handle is attached advantageously to the wax container, the operating element for the above mentioned regulating valve also having been arranged within easy reach of said handle. The wax container effectively is developed as a massive block made of light metal, in the bottom of which the heating coil, advantageously regulable by a thermostat, has been built in.

BRIEF DESCRIPTION OF THE DRAWINGS

In the drawing an embodiment of the device of the invention is shown by way of example.

DETAILED DESCRIPTION OF THE PREFERRED EMBODIMENT

Figure 1:
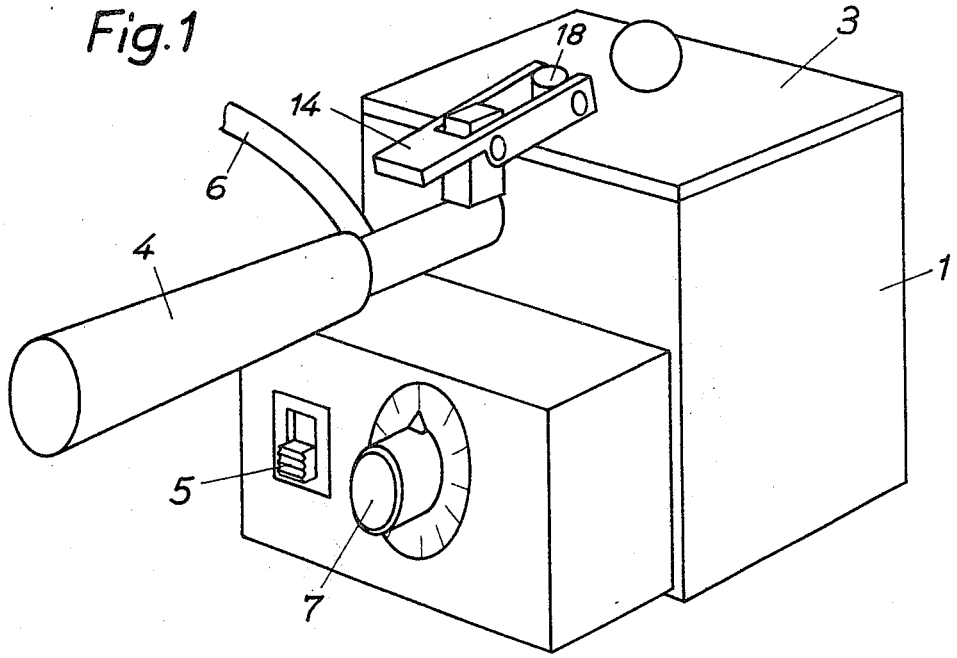
FIG. 1 shows a perspective view of the device.

The device shown has a wax container 2 formed in a massive light metal block 1, and in the floor of said container electrical heating elements, not shown, are attached. The container 2 can be closed by a lid 3 and is provided with a handle 4. A switch 5 serves for switching the current fed in through a cable 6 off and on. A regulating thermostat 7 serves in a manner know per se and therefore in a manner not shown, for the regulation of the current fed to the heating elements and thus of the temperature of the wax.

For use, block or flaky wax is inserted into the container 2 and is brought by the above mentioned heating elements to the temperature suited for the wax and determined by the thermostat, and is liquefied.

The wax container 2 has a discharge channel 8 (see FIG. 3) which is connected with the discharge openings 10, 11 by way of channels 9 drilled into the bottom of the block 1. The discharge of wax through the channel 8 can be regulated by a valve 12. Said valve can have for example, a valve stem, 18, having a cone shaped ending 19, which rests, under spring action 20, on the corresponding conically shaped valve seat 13. The valve can be lifted counter to the action of the above mentioned spring, by a rocker arm 14, disposed on the upperside of block 1, and as a result the wax discharge can be released. The rocker arm 14, as can be seen from the drawing, is attached within reach of the handle 4, so that the user of the device can hold said device with one hand and at the same time he can operate the rocker arm 14.

Figure 2:
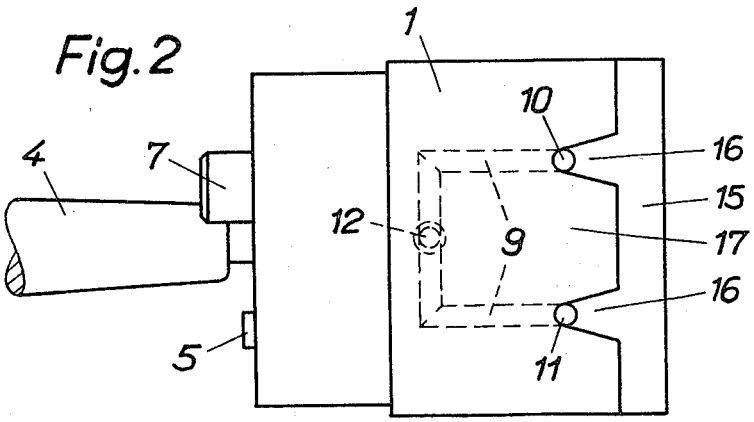
FIG. 2 is a view of the device from below.
Figure 3:
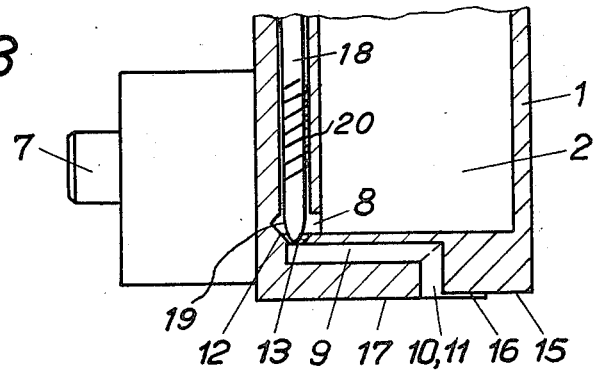
FIG. 3 shows a partial cut through the device.

The outside bottom surface of the container 2, which serves as the coating surface for the wax and into which the channels 8, 9 lead, has two surface parts displaced in regard to one another in the direction of height (see FIGS. 2, 3). The bottom part 15, including the approximately triangular sections 16, which latter comprise the openings 10, 11, is slightly displaced as compared to the guide surface 17. As a result of this displacement an optimum film of wax can be applied to the running surface of the skis. If one were to permit the openings 10, 11 to open in a completely even or flat surface, then the distribution of wax would be bad and the guidance of the device on the running surface would be difficult.

In use, the device which contains liquid wax in the wax container 2 is placed on to the running surface of the ski. The liquid wax at the same time can consist of only one or of more wax components. As a result of the operation of the valve 12, the wax outlet to the openings 10, 11 is released. Consequently the wax flows on to the running surface divided (separated) by a longitudinal groove. The arrangement of the triangular sections 16 prevents the wax from entering the longitudinal groove in question. The device is pulled across the running surface and the wax can be applied absolutely evenly. After completion of the application of wax, the valve 12 is closed and as a result the wax supply to the openings 10, 11 is discontinued. By a reciprocal movement of the device across the running surface, the necessary ironing in of the wax on the running surface is accomplished with the heated bottom of the block 1.

Instead of the two openings 10, 11, there could also be more than two openings. Instead of the longitudinally shiftable (slidable) valve 12, the shifting of the valve body could also be accomplished by a thread.

What is claimed is:

1. In a device for the application of ski wax to the running surface of a ski, said ski having a longitudinal groove on the running surface, by means of an electrically heatable wax container, the outside bottom surface of said container serving as an application surface, at least one wax discharge opening connected with the wax container by way of at least one closeable channel, heating means inside said container, the improvement comprising: a portion of the bottom surface displaced in relation to the remaining portion of the bottom surface, said displaced portion of said bottom surface having two approximately triangular surface portions thereon, each triangular surface portion having at least one wax discharge opening disposed thereon and in communication with said wax container by at least one channel such that wax is discharged on opposite sides of the longitudinal groove onto the running surface, said channel being selectively closed by a valve from said wax container and said remaining portion of said bottom surface being flat and heated by said heating means to uniformly coat the running surface of said ski.

2. A device as in claim 1, characterized in that said valve is a closing valve which can be operated manually by way of an operating element disposed near a handle.

3. A device as in claim 1, characterized in that said portions of the bottom surface of the wax container are formed as a light metal block, said heating means, controlled by a thermostat, and said displaced portion of said bottom surface forms a recess with respect to said remaining portion of said bottom surface.

* * * * *